United States Patent [19]

Easton

[11] 4,146,145

[45] Mar. 27, 1979

[54] BIN UNLOADER

[76] Inventor: Harlan J. Easton, R.F.D. #3, Blooming Prairie, Minn. 55917

[21] Appl. No.: 819,969

[22] Filed: Jul. 28, 1977

[51] Int. Cl.[2] ..... B65G 65/48

[52] U.S. Cl. ..... 414/312; 198/676; 222/404; 414/310

[58] Field of Search ..... 214/17 D, 17 DA; 198/616, 659, 676; 222/404, 412, 413

[56] References Cited

U.S. PATENT DOCUMENTS

| | | | |
|---|---|---|---|
| 2,711,814 | 6/1955 | McCarthy | 214/17 DA X |
| 3,084,814 | 4/1963 | Schaefer | 214/17 DA |
| 3,339,759 | 9/1967 | Wellons | 214/17 DA |
| 3,508,670 | 4/1970 | Schuld | 214/17 DA |
| 3,952,862 | 4/1976 | McCorkel | 198/676 |

*Primary Examiner*—Robert G. Sheridan
*Attorney, Agent, or Firm*—Merchant, Gould, Smith, Edell, Welter & Schmidt

[57] ABSTRACT

Apparatus for reliably causing flow of material from a bin, of circular transverse section about a vertical axis, having a conical bottom converging downwardly to a central discharge chamber, including: a central shaft rotatable in the discharge chamber about the vertical axis; a first arm on the central shaft for preventing material from said bin from packing around the central shaft; a second arm on the central shaft for preventing material from said bin from bridging at the entrance to the discharge chamber; a universal joint at the top of the central shaft; a traveller shaft connected at one end to the universal joint for rotation, with rotation of the central shaft, about its own axis and about the vertical axis; a single chain extending spirally around the traveller shaft for a major portion of its length and secured at both ends to the traveller shaft, for loosening material in the conical bottom of the bin by contact lateral of the traveller shaft therewith; a plurality of flat pieces of resilient material of rectangular outline centrally mounted spokewise on the end of the traveller shaft remote from the universal joint for frictionally engaging the inner surface of the conical bottom of the bin to propel the traveller shaft around the vertical axis; and a power source connected in driving relation to the central shaft.

1 Claim, 5 Drawing Figures

BIN UNLOADER

BACKGROUND OF THE INVENTION

This invention relates to the general field of agriculture, and specifically to means for reliably causing the flow of particulate material such as feed from a bin, of circular transverse section about a vertical axis, having a conical bottom converging downwardly to a central discharge chamber for subsequent removal of the material therefrom by conventional means such an auger conveyor.

Bins of the type just described, supported on peripheral legs of various sorts, are very common in agricultural communities. They are relatively easy to erect, relatively inexpensive, and conveniently filled using widely available equipment, and they give good protection to their contents against inclemencies of weather and attacks by rodents. Their principle defect lies in the difficulty frequently encountered in extracting their contents when it is desired to do so. The processes of settling and aging, aided by minute movement of particles according to temperature changes, frequently produces a condition known as bridging, in which material at the bottom of the bin forms a natural arch supporting the weight of the material above it, and resistent even to considerable impact of shovels and the like applied against the outside of the bin.

Bridging takes place most readily at the very bottom of the bin where the diameter is smallest, so that the span of the natural arch is the least: it seldom occurs when the span must be substantially a major portion of the bin diameter itself.

Numerous attempts have been made to overcome this difficulty, the most common being the provision of a traveller shaft driven through a universal joint by a central vertical power shaft to move around within the bin bottom and undercut any natural arching. For a full bin the amount of power required to move such a shaft transversely through the material is very great, and there is a considerable tendency for the traveller shaft to simply rotate about its own axis without moving around the bin axis, thus loosening for discharge only a small amount of the material in the bin. In attempts to enforce a positive drive between a coggged wheel at the outer end of the traveller shaft and a cogged track surrounding the conical bottom at its top has also been made, but this exacerbates the problem by multiplying both the power required of the drive motor and the required strength of all the components used.

It has also been found that even when released into the discharge space, material has a tendency to pack or bridge therein, so that an unloading auger is fed no material to discharge.

SUMMARY OF THE INVENTION

The present invention proposes to improve the operation of traveller shafts for bin unloading by the joint action of several simultaneously operative members including means on the central shaft for preventing not only packing of material therearound, but bridging of material at the entrance to the discharge chamber, and including modification of the traveller shaft to decrease its length and increase its ability to move transversely through the material by winding it with a chain and by mounting at its outer end an assembly of resilient members which cooperate to drive the traveller shaft frictionally around the bin.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENT

Figure 1:
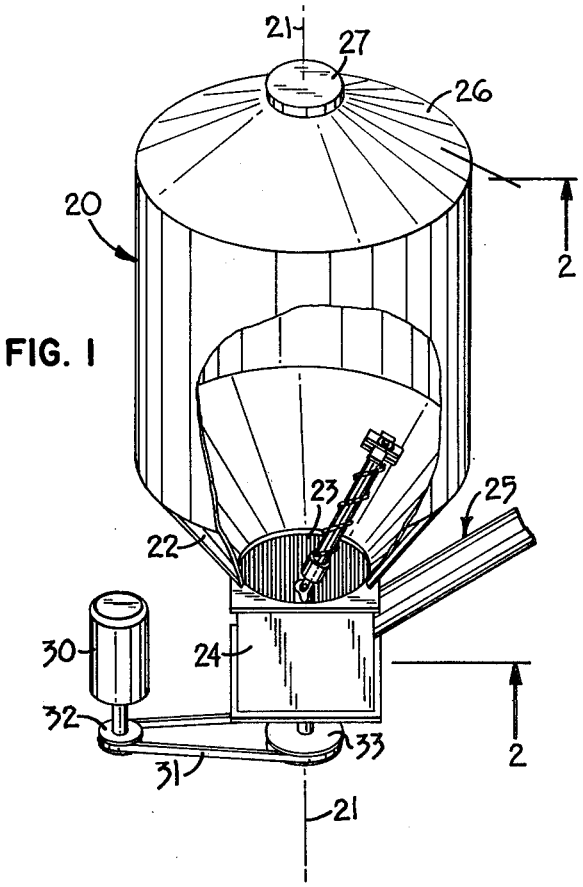
FIG. 1 is a perspective view of a bin with parts broken away to show an unloader according to my invention installed.
Figure 2:
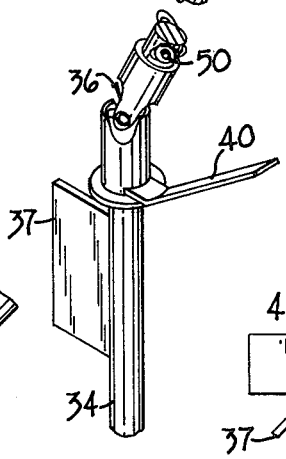
FIG. 2 is a longitudinal sectional view along the line 2—2 of FIG. 1.
Figure 2:
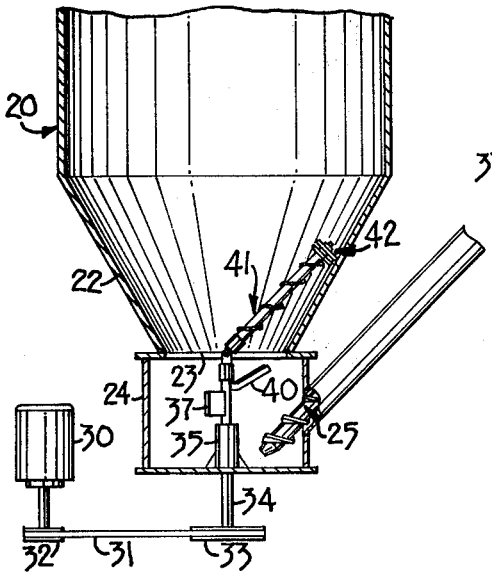

As shown in FIGS. 1 and 2 a bin 20 for storage of material such as feed is of a generally cylindrical configuration about a central vertical axis 21. It has a conical bottom 22 converging downwardly to an opening 23 into a central discharge chamber 24 into which there is shown to project an unloading auger 25. The top 26 of bin 20 has an inspection and filling manhole 27.

Bin 20 is mounted on any suitable base or legs, not shown, as is a motor 30 which acts through a belt 31 and pulleys 32 and 33 to drive a vertical shaft 34 carried in a bearing 35 in the bottom of discharge chamber 24. At its upper end shaft 34 carries a universal joint 36. Projecting from shaft 34 radially is a member 37 which functions, when shaft 34 rotates, to prevent packing of material around the shaft. Also projecting from shaft 34, in a radially outward and upward direction, is a second member 40 which sweeps through the entrance between bottom 22 and chamber 24 to prevent bridging of material there.

Figure 4:
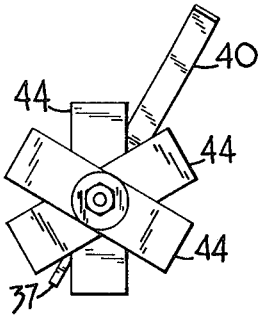
FIG. 4 is an end view of the unloader to a still larger scale.
Figure 3:
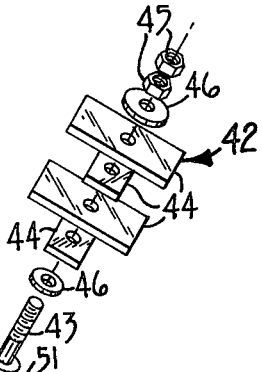
FIG. 3 shows an unloader according to my invention, to a larger scale.
Figure 5:
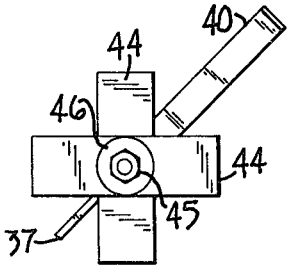
FIG. 5 is a view similar to FIG. 4 of a modified unloader.

A traveller shaft 41 is connected at one end to universal joint 36, and the length of the shaft is about one-half the slant height of conical bottom 22. Resilient means 42, for engaging the inner surface of conical bottom 22 with rolling friction, is carried on a threaded end portion 43 of shaft 41, and comprises a plurality of flat pieces 44 of material such as belting, or rectangular outline, which are centrally apertured and fixedly secured spoke-wise to end 43 of shaft 41 by nuts 45 and washers 46, for rotation unitary with shaft 41. In FIGS. 3 and 4 a plurality of four of these pieces 44 are stacked at 90° angles around shaft 41. FIG. 5 shows a plurality of three of these pieces angularly spaced equally around the shaft.

These structures function to provide an outboard support for shaft 41 which can ride on the inner surface of bin 22 and provide some frictional drive to propel traveller shaft 41 around the bin, without undue wear of the bin bottom.

In order to improve the action of shaft 41 in loosening material as it turns, a single chain 47 is wrapped around the shaft and secured firmly to it at both ends by fasteners 50 and 51.

Operation

Bin 20 is loaded through manhole 27 by conventional elevating equipment, in known fashion. When it is desired later to unload the bin, auger 25 is set in motion, and operation of motor 30 is initiated. Auger operation has created some free space in discharge chamber 24, to enable rotation of shaft 34, and member 37 prevents packing of material around the shaft and instead feeds the material to where auger 25 can receive it At the same time member 40 undercuts any bridging of material at opening 23, so that material can flow to auger 25.

Traveller shaft 41 is buried in material, and cannot rotate freely about axis 21. It can however, rotate about its own axis because of universal joint 36. Chain 41 engages the material transversely of its shaft, loosening it to fall into discharge chamber 24, and rotation of member 42 against bin bottom 22 frictionally urges shaft 41 to rotate slowly about axis 21, thus breaking up any bridging and allowing the loosened material to descend into chamber 24. By the time the traveller shaft has completed a circuit of the bin all significant bridging has been broken up, the diameter of the bin above member 42 being so great that bridging does not occur there.

The fact that there is no positive drive of traveller shaft around axis 21 greatly reduces the load on the mechanism and the power required from motor 30: if an area of increased compaction of material occurs, rotation about axis 21 may substantially cease, but the action of chain 47 continually creates a small space for advance, and the traveller shaft slowly makes its way through the material until a normal storage condition is again encountered.

From the above it will be clear that I have invented a new bin unloader with special features to prevent and overcome packing and bridging of stored material, which reduces the strain on the mechanisms involved and decreases the size of the driving motor required.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. Apparatus for reliably causing discharge of material to an unloading auger from a bin, of circular transverse section about a vertical axis, having a conical bottom converging downwardly to a central discharge chamber therebeneath enclosing one end of the auger, comprising, in combination:

a central shaft rotatable in said discharge chamber about said vertical axis;

a universal joint at the top of said central shaft and above the apex of said conical bottom if extended;

a traveller shaft having a length generally half the slant length of the conical bottom and connected at one end to said universal joint for rotation, with rotation of said central shaft, about its own axis and about said vertical axis, said shaft making with said vertical axis an angle substantially greater than that made by said conical bottom;

means carried by said traveller shaft along its length, including a chain wound closely thereabout in a spiral and secured thereto solely at its ends, for loosening material in said conical bottom of said bin by contact lateral of said traveller shaft therewith;

resilient means rotatable with said traveller shaft and located at the end thereof remote from said universal joint for supporting the outer end of said traveller shaft and continuously frictionally engaging the inner surface of said conical bottom to propel said traveller shaft around said vertical axis, said resilient means comprising a plurality of flat pieces of resilient material of rectangular outline mounted spoke-wise on said traveller shaft;

means, of larger axial extent than radial extent, carried by said central shaft for sweeping through said chamber to prevent packing of materials from said bin around said shaft;

means, of larger radial extent than lateral extent, carried by said central shaft near the upper end thereof for sweeping through the space at the connection of said chamber with said bottom to prevent bridging of material from said bin at the entrance to said discharge chamber; and motor means for causing rotation of said central shaft and said traveller shaft independent of operation of said unloading auger.

* * * * *